US005782667A

United States Patent [19]

Luby

[11] Patent Number: 5,782,667

[45] Date of Patent: Jul. 21, 1998

[54] SCULPTURE AMUSEMENT DEVICE

[76] Inventor: Toro Luby, 3828 Trenton Dr., Lithonia, Ga. 30058

[21] Appl. No.: 551,377

[22] Filed: Nov. 1, 1995

[51] Int. Cl.[6] ..... A63H 33/04

[52] U.S. Cl. ..... 446/69; 446/85; 446/117

[58] Field of Search ..... 446/69, 85, 117, 446/124; D21/108; 434/211, 403

[56] References Cited

U.S. PATENT DOCUMENTS

| | | | |
|---|---|---|---|
| 243,362 | 6/1881 | Crandall . | |
| 261,912 | 8/1882 | Crandall . | |
| 264,066 | 9/1882 | Crandall . | |
| 595,455 | 12/1897 | Glidden . | |
| 741,949 | 10/1903 | Woodson . | |
| 3,815,282 | 6/1974 | Frost . | |
| 4,643,427 | 2/1987 | Wozniak | 446/85 X |
| 4,983,137 | 1/1991 | Carpenter . | |

*Primary Examiner*—Mickey Yu
*Attorney, Agent, or Firm*—Troutman Sanders LLP; Gerald R. Boss

[57] ABSTRACT

A sculpture amusement device includes a plurality of elements which are adapted be arranged into a plurality of two- and three-dimensional sculptures. The device includes a first stack of interior elements and a second stack of exterior elements. Each interior element includes a front surface and a rear surface, wherein a width of the interior element front surface incrementally decreases with increasing height position in its stack. Each exterior element includes first and second front surfaces, an inside surface disposed between the first and second front surfaces, and a rear surface. Each exterior element inside surface is complementary to each interior element rear surface at corresponding height positions within their respective stacks to form nested pairs of interior and exterior elements. That nesting feature allows efficient stacking and packaging of the set of elements, and allows a user to create attractive two- and three-dimensional sculptures from the elements. The elements of the present invention may be constructed from any substantially rigid material that is safe for young children, and some or all of the elements may be of different colors to attract attention from young children, or for decorative effects.

8 Claims, 9 Drawing Sheets

SCULPTURE AMUSEMENT DEVICE

BACKGROUND OF THE INVENTION

1. Technical Field

This invention relates generally to amusement devices, and more particularly to amusement devices which include a plurality of blocks or elements for assembling and disassembling various two- and three-dimensional shapes or sculptures.

2. Description of the Prior Art

Many prior art building block devices allow a child to assemble and disassemble various block configurations. However, most previous designs strongly encourage a particular block construction configuration. For example, U.S. Pat. No. 243,362 discloses a set of nested, rectangular boxes which fit within one another in a telescopic fashion. Each block has a particular size and letter identification. The telescopic relationship between each of the blocks insures that a child may assemble the blocks in only one order, so as to reinforce the order of the letters of the alphabet during assembly of the block set. Unfortunately, that set of blocks only allows one particular configuration for assembly.

U.S. Pat. No. 264,066 discloses a toy tower comprised of a stack of blocks having a decreasing width in relation to increasing block height position in the stack. Each of the blocks includes a single letter of the alphabet on a side thereof. Here again, the blocks may be assembled in only one particular order for the purpose of creating a tower of blocks having the alphabet displayed in order from the top block to the base block.

U.S. Pat. No. 595,455 also discloses spherical-, cubic-, and pyramidal-shaped nested block sets for a child's amusement. This design also encourages the child to assemble the blocks into a particular order, as is encouraged by the telescoping and nested relationship between blocks of respective sets.

Other amusement devices limit creativity by encouraging a child to arrange the blocks into only two-dimensional designs. For example, U.S. Pat. No. 4,983,137 discloses a design and construction toy which includes a plurality of rigid elements arranged in a nested fashion. An outline of each element essentially forms an equilateral triangle. While that construction toy is arranged in a nested fashion, its design essentially encourages two-dimensional designs rather than three-dimensional designs.

Finally, U.S. Pat. No. 741,749 discloses a block set that, when assembled, resembles a cylindrical solid which has been cut into radial, circumferential, and transverse sections. Although that block set may be arranged in various two- and three-dimensional configurations, that block set design is essentially limited only a few configurations.

SUMMARY OF THE INVENTION

The present invention recognizes and addresses the foregoing disadvantages, and others of prior art constructions and methods.

Accordingly, it is an object of the present invention to provide a set of blocks which allows a child or a person of any age to create two- and three-dimensional block configurations.

It is another object of the present invention to provide a block set design which allows a plurality of block stacking orders.

Finally, another object of the present invention is to provide a set of blocks which may be easily and compactly stored between usages.

Generally speaking, the invention relates to a sculpture amusement device formed of a plurality of elements which are adapted to be stacked into two- and three-dimensional sculptures. Although adapted for use by children, a person of any age may create a plurality of different sculptures from the set of elements.

More specifically, the invention includes a first stack of interior elements and a second stack of exterior elements. Each interior element includes a front surface and a rear surface, wherein a width of the interior element front surface incrementally decreases with increasing height position in its stack. In the second stack of exterior elements, each exterior element includes first and second front surfaces, an inside surface disposed between the first and second front surfaces, and a rear surface.

Each exterior element inside surface is complementary to only one interior element rear surface to form nested pairs of interior and exterior elements. That nesting feature allows efficient stacking and packaging of the set of elements, and allows a user to create attractive two- and three-dimensional sculptures from the blocks.

One characteristic of the present invention relates to the total front surface area of nested pairs of elements. The total front surface area for a particular pair of nested elements comprises the areas of first and second front surfaces of an exterior element and the front surface of an interior element. Specifically, a total front surface area of front surfaces of each nested pair of interior and exterior elements is the same, regardless of the nested pair's position in the stack of blocks. This feature allows consistency in total size, facilitates stackability, and allows for several pairs of stacks of nested elements to be packaged together.

The amusement device according to the present invention may also include a base element disposed below the first and second stacks. The base element includes a front surface and a rear surface, and the front surface includes an area equal to the total front surface area of each nested pair of elements within the first and second stacks.

Additionally, the amusement device may include a cover element disposed on top of the first and second stacks. The cover element includes a front surface and a rear surface, and the cover element front surface comprises an area equal to the total front surface area of each nested pair of elements within the first and second stacks.

Another characteristic feature of the present invention relates to each individual element's total front surface area as a function of its stacking position. Given the stacking order as specified above, an interior element disposed at a given distance downward from a top element position in the first stack has a front surface area equal to a total surface area of the first and second front surfaces of an exterior element located at an element position within the stack at that same distance upward from a bottom element position in the second stack.

Additionally, interior elements disposed at a distance upward from a geometrical center the first stack have a front surface area equal to a total area of the first and second front surfaces of exterior elements located at an element position within the first stack at that same distance downward from the geometrical center.

Moreover, top surfaces of nested pairs of interior and exterior elements have a total top surface area which is the same for each nested pair throughout the first and second stacks. Similarly, bottom surfaces of nested pairs of interior and exterior elements have a total bottom surface area which is the same for each said nested pair throughout the first and second stacks.

The interior and exterior elements within the set may have virtually any shape which allows the above-referenced relationships to exist between nested pairs of interior and exterior elements. For example, each interior element may be a semi-circular solid having a rear surface which is adapted to be complimentary with an inside surface of a substantially C-shaped exterior element. In that example, the first and second stacks of nested interior and exterior elements form a semi-cylindrical solid. Furthermore, the amusement device may include two sets of semi-cylindrical stacks adapted to form a complete cylindrical solid.

Additionally, each interior element may be in the shape of a triangular solid, and each exterior element may be substantially V-shaped, such that the first and second stacks of nested interior and exterior elements form a triangular solid. Additionally, the amusement device according to the present invention may also include two sets of triangular solid stacks adapted to form a complete tetrahedron solid.

Finally, the stackable elements of the present invention may be constructed from any substantially rigid material that is safe for young children. Examples of such material include, but are not limited to wood, plastic, ceramic, or sheet metal. The elements may all be of a single color, however, some or all of the elements may be of different colors to attract attention from young children, or for decorative effects.

Other objects, features and aspects of the present invention are discussed in greater detail below.

BRIEF DESCRIPTION OF THE DRAWINGS

The accompanying drawings illustrate the preferred embodiment of the invention, and serve to aid in the explanation of the principles of the invention.

DETAILED DESCRIPTION OF THE INVENTION

Figure 1:
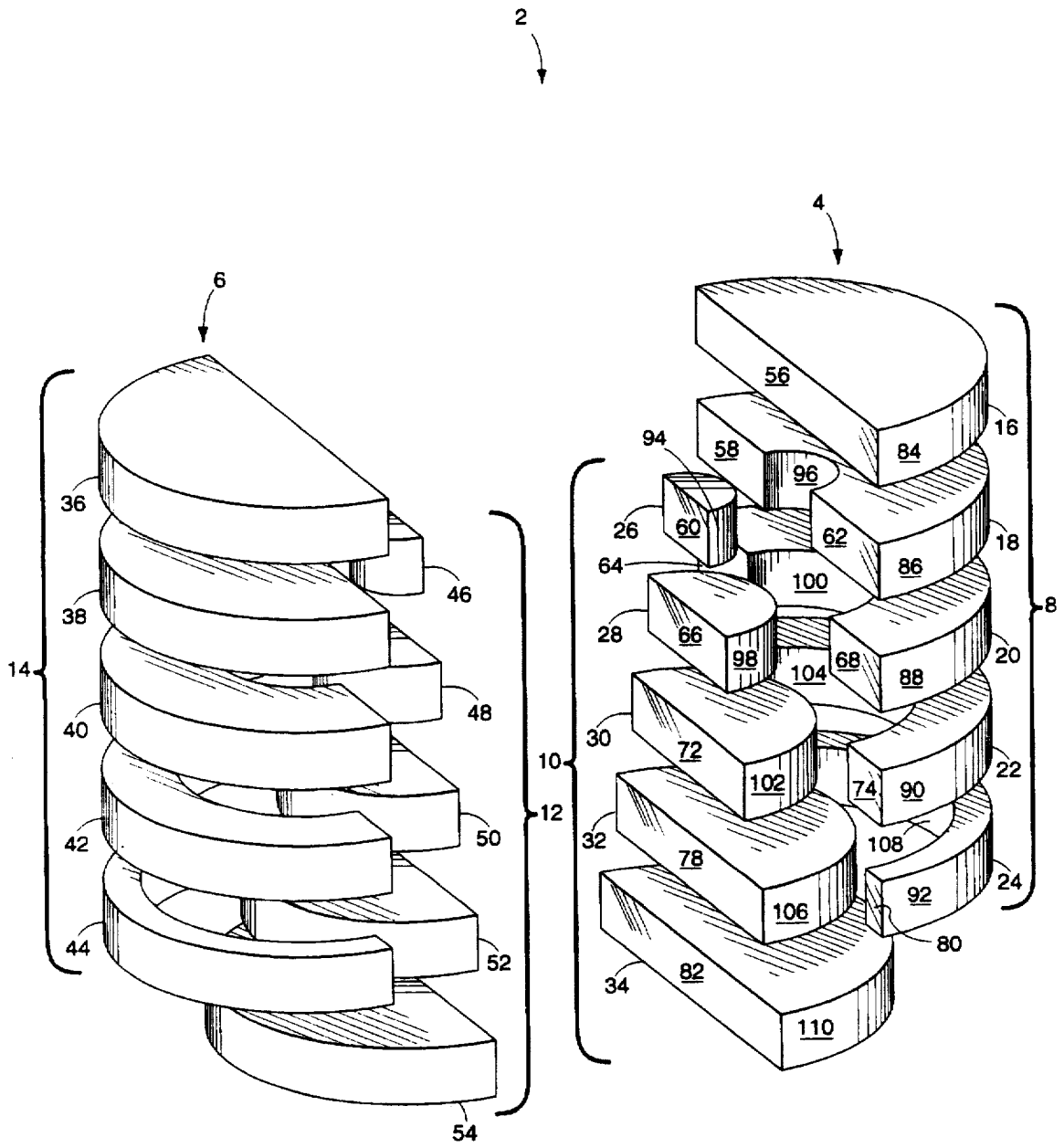
FIG. 1 is an exploded view of a set of round blocks configured in accordance with a first embodiment of the present invention.

FIG. 1 illustrates a first embodiment of the amusement device 2 according to the present invention. Amusement device 2 may include two sets 4 and 6 of stackable elements or blocks. Each set of stackable elements includes generally two stacks. For example, set 4 includes a stack 10 of interior elements and a stack 8 of exterior elements. Similarly, set 6 consists of an interior stack of elements 12 and an exterior stack of elements 14.

Referring to set 4, the stack 10 of interior elements consists of essentially semi-circular solids. For example, elements 26, 28, 30, 32 and 34 each include a flat front face 60, 66, 72, 78 and 82, respectively. Additionally, each one of the interior elements includes a semi-circular rear surface. Specifically, elements 26, 28, 30, 32, and 34 include rear surfaces 94, 98, 102, 106, and 110, respectively. Element 34 essentially comprises a base for stack 10.

Set 4 also includes a stack of exterior elements 8. Specifically, stack 8 is comprised of elements 16, 18, 20, 22 and 24. Element 16 essentially comprises a cover element for the set 4 of elements. Element 16 includes a front flat surface 56 and a rear semi-circular surface 84. The remaining elements in stack 8 of set 4 each include three front surfaces. Specifically, each element includes two flat front surfaces and an inside surface disposed between the two flat front surfaces. For example, element 18 includes two flat front surfaces 58 and 62 which are disposed on either side of interior surface 96. Similarly, element 20 includes two front flat surfaces 64 and 68 each of which surround interior surface 100. As seen from FIGS. 1, 2, and 3, element 22 includes two flat front surfaces 70 and 74 with surface 104 disposed therebetween. Finally, element 24 includes two flat front surfaces 76 and 80 with an inside surface 108 disposed therebetween.

As is seen from FIG. 1, a rear surface of an interior element is complementary to only one inside surface of a single exterior element. For example, rear surface 94 of interior element 26 is complementary only to inside surface 96 of exterior element 18. Similarly, rear surface 98 of interior element 28 is complementary to only inside surface 100 of exterior element 20. Similarly, rear surface 102 of interior element 30 is complementary only to inside surface 104 of exterior element 22. Finally, rear surface 106 of element 32 is complementary only to inside surface 108 of exterior element 24.

Figure 2:
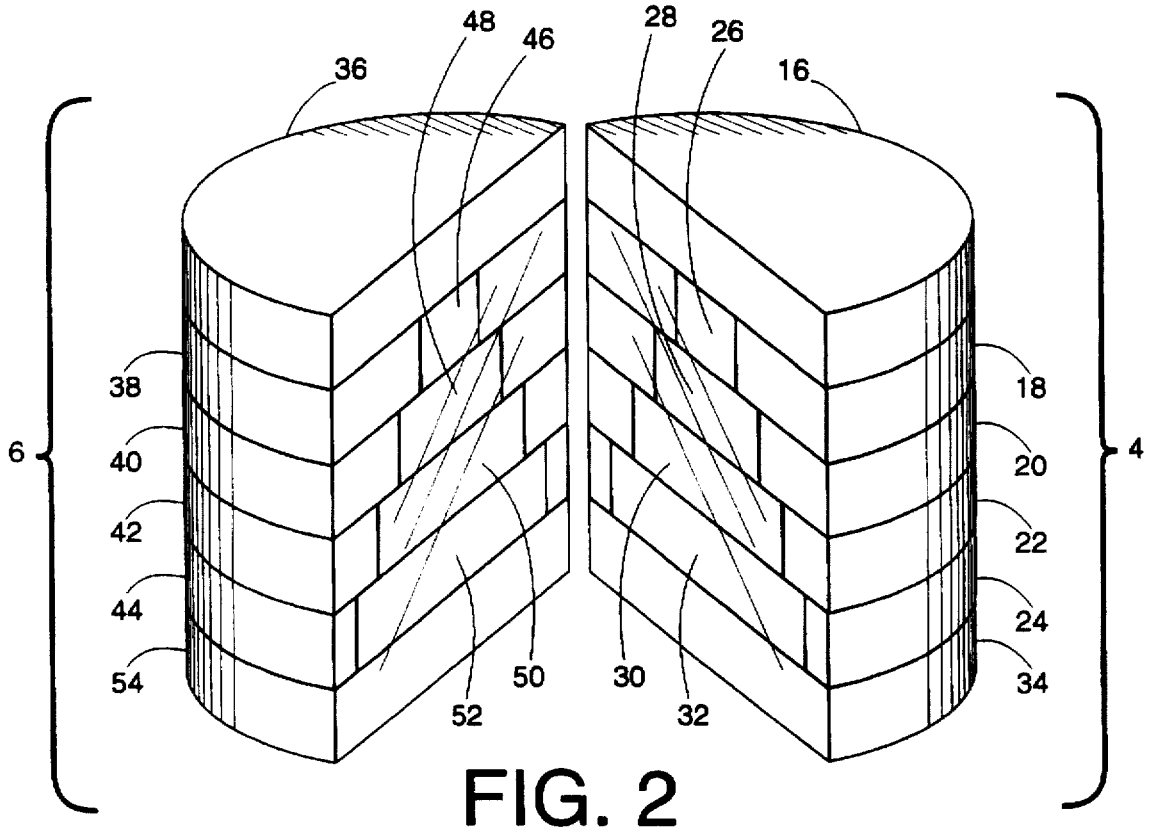
FIG. 2 is a top, front perspective view of the set of blocks illustrated in FIG. 1 shown in a stacked arrangement
Figure 3:
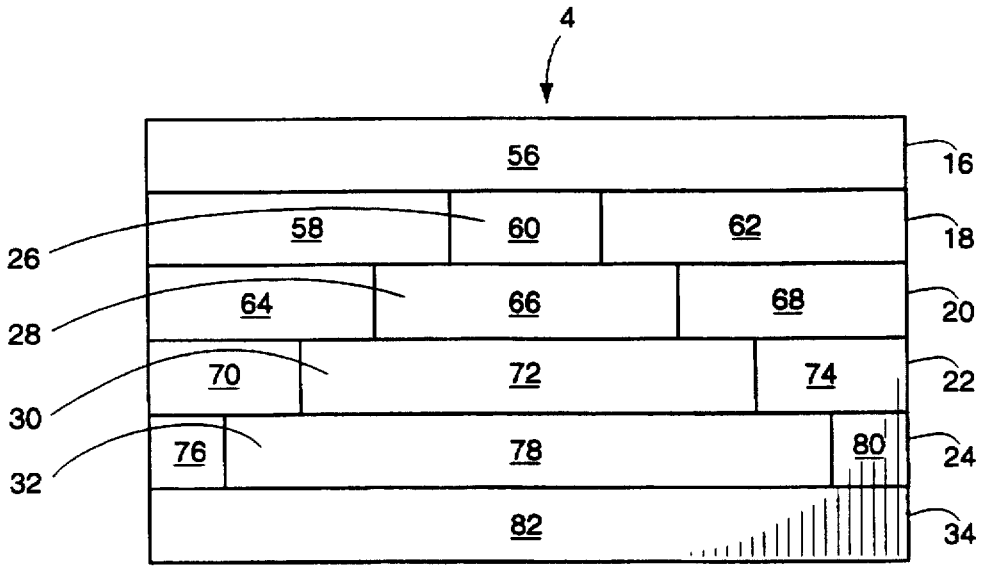
FIG. 3 is a front plan view of a stack of blocks configured in accordance with the first embodiment of the present invention.

As FIGS. 1, 2 and 3 illustrate, when respective interior and exterior element pairs are placed adjacent to one another, they form a semi-cylindrical solid having the same top surface area as cover element 16 and base element 34. Specifically, elements 26 and 18, are complimentary to one another, as described above, and when placed adjacent to one another, form a flat, planar front surface as shown in FIG. 3 comprised of surfaces 58, 60, and 62 which is equal in surface area to that of front surface 56 of cover or element elements 16. Similarly, interior element 28 and exterior element 20 form a semi-cylindrical solid. Elements 30 and 22 form such a solid as well as elements 32 and 24. As can be seen from FIGS. 1, 2, and 3, each respective pair of interior and exterior elements has the same total top surface area as the base and cover elements 34 and 16.

Thus, each of sets 4 and 6 is essentially formed from nested pairs of interior and exterior elements. As is seen from FIGS. 1, 2, and 3, the front surfaces of the exterior elements increase in surface area with an increasing element height position in their respective stacks 8 and 14. Interior elements 26, 28, 30, 32, and 34 having an increasing frontal surface area as a function of decreasing height position in the stack.

Another important feature of the present invention involves the relationships between front surface areas of the interior elements as compared to front surface areas of the exterior elements of each of stacks 8, 10, 12, and 14. Specifically, interior elements disposed at a distance downward from a top position in each of their respective stacks 10 and 12 each have a front surface area equal to a total surface area of the first and second flat front surfaces of exterior elements located in element position within stacks 8 and 10 at the same distance upward from a bottom element position in a stack.

For example, referring to FIG. 3, the surface areas of front surfaces 76 and 80 on exterior element 24 are equal to the surface area of front surface 60 of interior element 24. Similarly, the total area of front surface 70 and front surface 74 within exterior element 22 equals the total surface area of 66 of element 28. Furthermore, as mentioned above, the area of front surface 82 of base element 34 equals the area of front surface 56 of element 16. Moreover, the total area of surfaces 58 and 62 of exterior element 18 equals the area of surface area 78 within element 32. Finally, the total area of front surfaces 64 and 68 of exterior element 20 are equal to a total area of front surface 72 of interior element 30. Additionally, since the height of interior and exterior elements is generally identical, the same relationships exist regarding widths of respective surfaces in exterior and interior elements.

As is seen best from FIG. 2, sets 4 and 6 may be combined together to form a complete cylindrical solid. Although the elements of the present invention may be of any suitable size, an example of relative sizes of the elements are as follows: base element 34 may be 7.5 inches in diameter; interior element 32 may be 6.0 inches in diameter; interior element 30 may be 4.5 inches in diameter; interior element 28 may be 3.0 inches in diameter; interior element 26 may be 1.5 inches in diameter; element 16 may also have a diameter of 7.5 inches. Furthermore, exterior diameters of cover 16 and base 34 are both 7.5 inches. Additionally, a diameter of the cut out within interior element 18 which forms inside surface 96 may have a diameter of 1.5 inches. The diameter of the cut out which forms inside surface 100 in exterior element 120 may have a diameter of 3.0 inches, the inside surface 104 of exterior element may have a diameter of 4.5 inches, and the inside surface 108 of exterior element 24 may have a diameter of 6.0 inches.

Although those dimensions are used as an example in this particular embodiment, any dimensions may be utilized which produces the surface area relationships described above. Finally, although any thickness may be utilized for the above-referenced invention, 0.75 inches is preferred in this embodiment. Additionally, each set of nested pairs within sets 4 and 6 may also have differing thicknesses, increasing thicknesses as a function of element height position in their respective stacks, or decreasing thicknesses as a function of element height within their respective stacks.

Furthermore, it is important to note that the sets 4 and 6 illustrated in FIG. 1 each have stacks of interior and exterior elements that are identical in their dimensions. Therefore the entire description set out above relating to dimensional relationships between nested elements, and surface areas of stacks 8 and 10 within set 4 also applies to stacks 12 and 14 within set 6. Therefore, the dimensions of interior and exterior elements of set 6 in any amusement device are identical to those of set 4.

Figure 4:
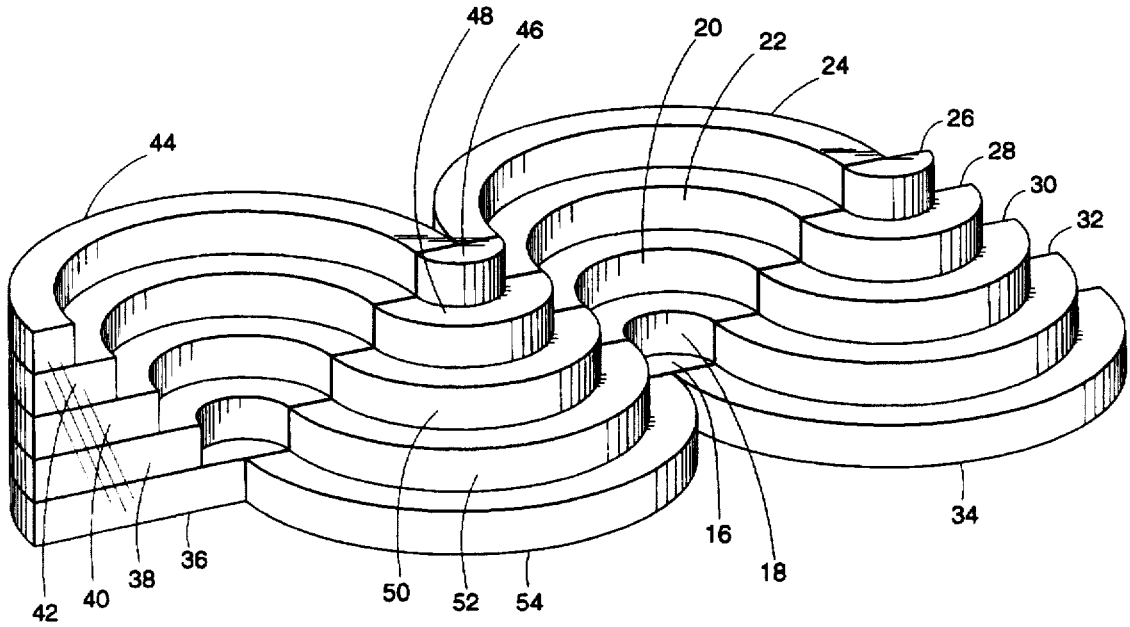
FIG. 4 is a perspective view of an example of a three-dimensional tierred sculpture utilizing the first embodiment of the inventive set of blocks of FIG. 1, illustrating the dimensional relationships between inside and outside diameters of each block with respect to stacking position.

FIG. 4 illustrates one of many three-dimensional sculptures which can be created with the present invention. In this particular sculpture, inside element 46 covers front surfaces of outside elements 44 and 24. Similarly, inside element 48 covers front surfaces of exterior elements 42 and 22. Interior element 50 covers front surfaces of exterior elements 20 and 40, and a front surface of interior element 52 covers front surfaces of exterior element 38. Similarly, a front surface of element 54 covers half of a front surface of element 36 and half of a front surface of element 16. Half of a front surface of element 34 covers the remaining half of element 16. Additionally, interior elements 32, 30, 28 and 26 are each stacked on one another to form a tierred relationship as described above, and each covers remaining front faces of exterior elements 18, 20, 22 and 24. The resulting sculpture is one having stepped contours of semi-circular curvatures. Although FIG. 4 illustrates a specific type of three-dimensional sculpture, a multitude of three-dimensional sculptures may be created using the present invention.

Figure 5:
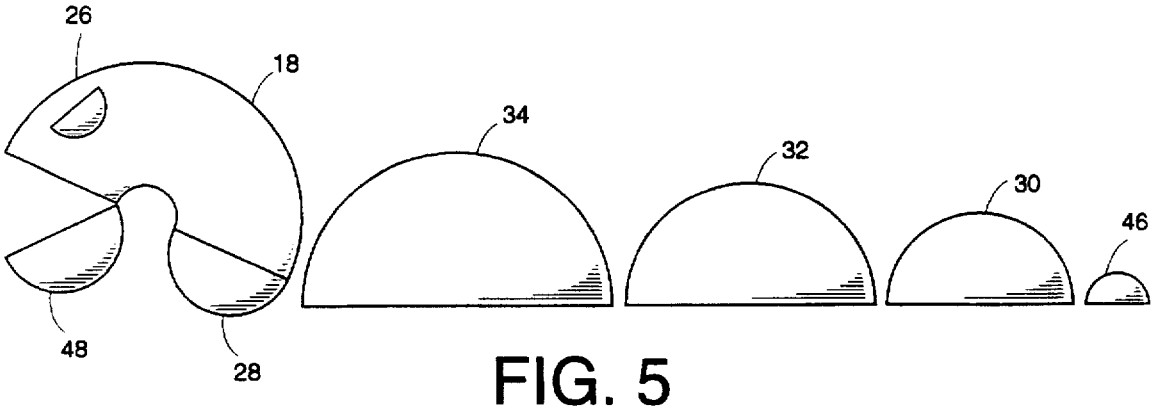
FIG. 5 is a plan view of an example of a two-dimensional sculpture formed from the first embodiment of the inventive set of blocks.
Figure 6:
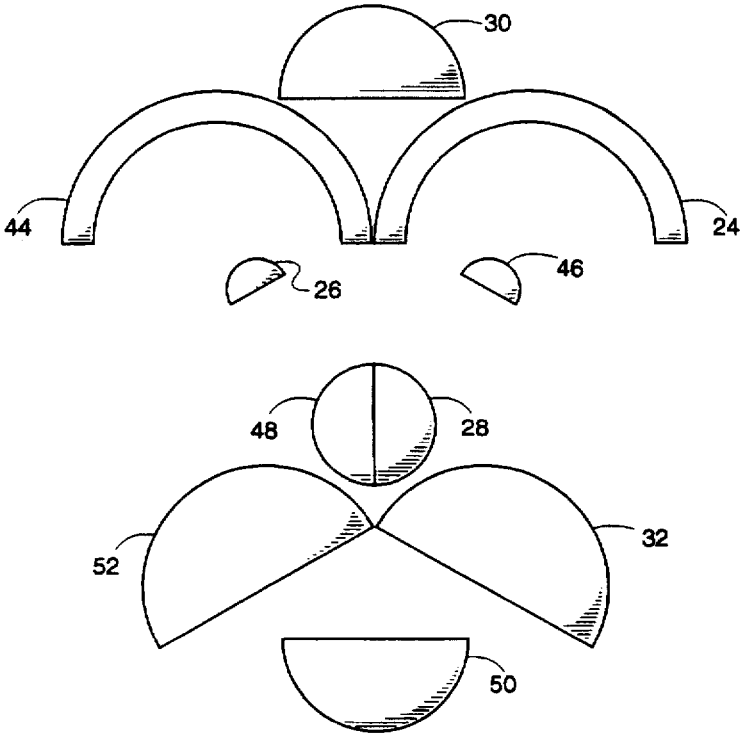
FIG. 6 is a plan view of another example of a two-dimensional sculpture formed from the first embodiment of the inventive set of blocks.

FIGS. 5 and 6 each illustrate two-dimensional sculptures which the amusement device may create. For example, FIG. 5 illustrates a caterpillar-like device having a head portion defined by exterior element 18, an eye defined by exterior element 26, a jaw portion defined by interior element 48, and a lower head portion defined by element 28. Additionally, the one-dimensional sculpture of the caterpillar includes elements 34, 32 and 30 as a body, and element 36 as a tail.

FIG. 6 illustrates yet another example of a one-dimensional sculpture that can be created with the set of elements. The sculpture generally resembles the face of a animal-like being wherein elements 26 and 28 resemble eyes, elements 44 and 24 resemble eyebrows or eye outlines, element 30 represents a top portion of the being's head, elements 48 and 28 represent a nose, and elements 52, 32 and 50 each represent a mouth of the being.

Figure 7:
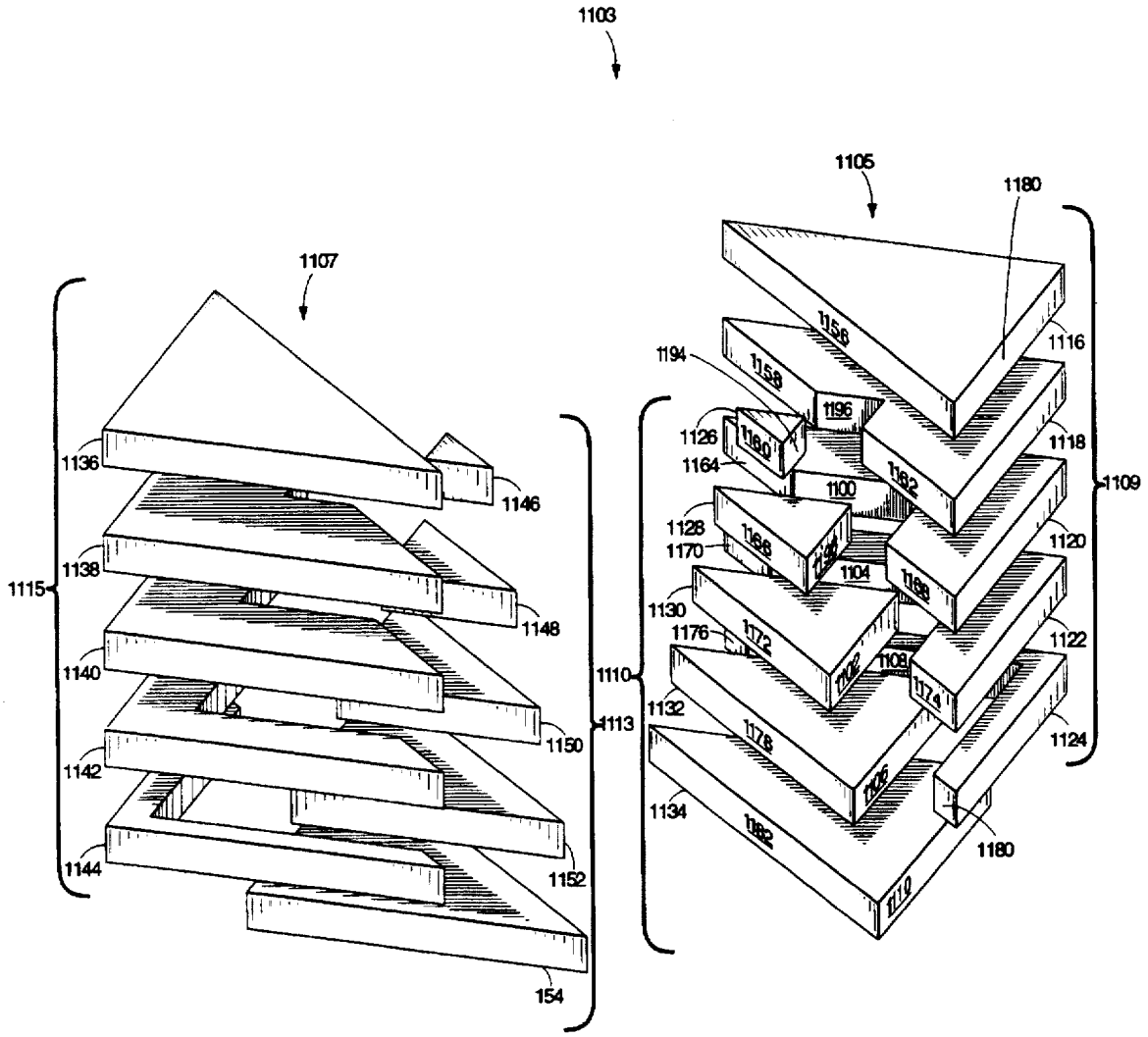
FIG. 7 is an exploded view of a set of blocks configured in accordance with a second embodiment of the present invention.

FIG. 7 illustrates a second embodiment 1103 of the amusement device according to the present invention. Amusement device 1102 may consist of two sets 1105 and 1107 of stackable elements or blocks. Each set of stackable elements includes generally two stacks. For example, set 1105 includes a stack 1111 of interior elements and a set 1109 of exterior elements. Similarly, set 1107 consists of an interior stack of elements 1113 and a stack of exterior elements 1115.

Referring to set 1105, the stack 1111 of interior elements consists of essentially triangular solids. For example, elements 1126, 1128, 1130, 1132 and 1134 each include a flat front face 1160, 1166, 1172, 1178 and 1182, respectively. Additionally, each one of the interior elements includes a V-shaped rear surface. Specifically, elements 1126, 1128, 1130, 1132, and 1134 include rear surfaces 1194, 1198, 1102, 1106, and 1110, respectively. Element 1134 essentially comprises a base for set 1105.

Set 1105 also includes a stack of exterior elements 1109. Specifically, stack 1109 is comprised of elements 1116, 1118, 1120, 1122 and 1124. Element 1116 essentially comprises a cover element for the set 1105 of elements. Element 1116 includes a front flat surface 1156 and a rear V-shaped surface 1184. The remaining elements in stack 1108 of set 1104 each include three interior surfaces, and rear V-shaped surfaces. Specifically, each element includes two flat front surfaces and a V-shaped inside surface disposed between the two flat front surfaces. For example, element 1118 includes two flat front surfaces 1158 and 1162 which are disposed on either side of V-shaped interior surface 1196. Similarly, element 1120 includes two front flat surfaces 1164 and 1168 each of which surround V-shaped interior surface 1100. As seen from FIGS. 7, 8, and 9, element 1122 includes two flat front surfaces 1170 and 1174 with V-shaped surface 1104 disposed therebetween. Finally, element 1124 includes two flat front surfaces 1176 and 1180 with V-shaped inside surface 1108 disposed therebetween.

As is seen from FIG. 7, a rear surface of an interior element is complementary to only one front surface of a single exterior element. For example, rear surface 1194 of interior element 1126 is complementary only to inside surface 1196 of exterior element 1118. Similarly, rear surface 1198 of interior element 1128 is complementary to only inside surface 1100 of exterior element 1120. Similarly, rear surface 1102 of interior element 1130 is complementary only to inside surface 1104 of exterior element 1122. Finally, rear surface 1106 of element 1132 is complementary only to inside surface 1108 of exterior element 1124.

Figure 8:
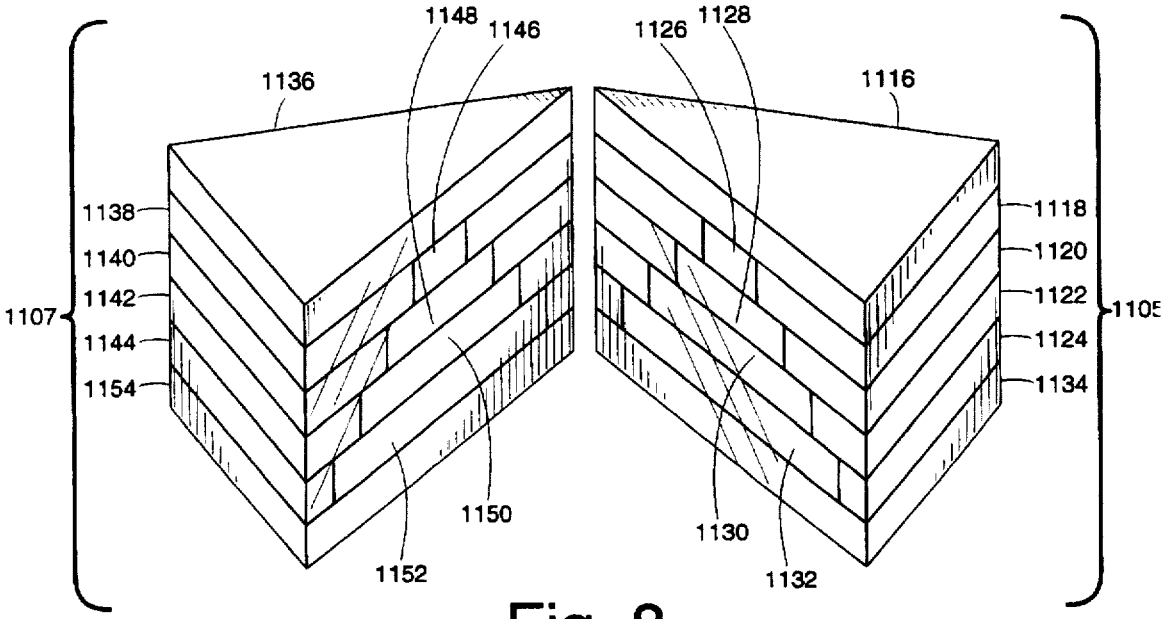
FIG. 8 is a perspective view of an example of a three-dimensional tierred sculpture utilizing the second embodiment of the inventive set of blocks of FIG. 7, illustrating the dimensional relationships between inside and outside diameters of each block with respect to stacking position.
Figure 9:
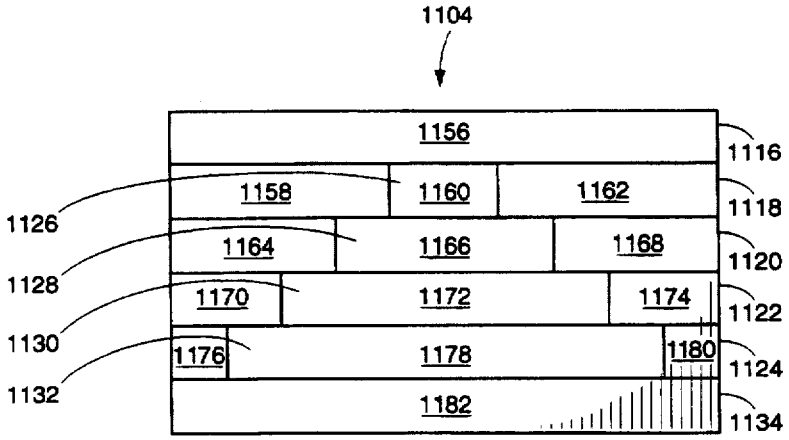
FIG. 9 is a front view of the second embodiment of the set of blocks configured in accordance with the present invention.

As FIGS. 7, 8 and 9 illustrate, when respective interior and exterior element pairs are placed adjacent to one another, they form a triangular solid having the same top surface area as cover element or element 1116 and base element or element 1134. Specifically, elements 1126 and 1118 are complimentary to one another, as described above, and when placed adjacent to one another, form a flat, planar front surface as shown in FIG. 9 comprised of surfaces 1158, 1160, and 1162 which is equal in surface area to that of front surface 1156 of cover or element elements 1116. Similarly, interior element 1128 and exterior element 1120 form a triangular solid. Elements or elements 1130 and 1122 form such a solid as well as elements 1132 and 1124. As can be seen from FIGS. 7, 8, and 9, each respective pair of interior and exterior elements has the same total top surface area as the base and cover elements 1134 and 1116.

Thus, each of stacks 1105 and 1107 is essentially formed from nested pairs of interior and exterior elements. As is seen from FIGS. 7, 8 and 9, the front surfaces of the exterior elements increase in surface area with an increasing element height position in their respective stacks 1109 and 1115. Interior elements 1126, 1128, 1130, 1132 and 1134 having an increasing frontal surface area as a function of decreasing height position in the stack.

Another important feature of the present invention involves the relationships between front surface areas of the interior elements as compared to front surface areas of the exterior elements of each of stacks 1109, 1111, 1115 and 1113. Specifically, interior elements disposed at a distance downward from a top position in each of their respective stacks 1111 and 1113 each have a front surface area equal to a total surface area of the first and second flat front surfaces of exterior elements located in element position within stacks 1109 and 1115 at the same distance upward from a bottom element position in a stack.

For example, referring to FIG. 9, the total surface area of front surfaces 1176 and 1180 on exterior element 1124 is equal to the surface area of front surface 1160 of interior element 1126. Similarly, the total area of front surface 1170 and front surface 1174 within exterior element 1122 equals the total surface area of 1166 of element 1128. Furthermore, as mentioned above, the area of front surface 1182 of base element 1134 equals the area of front surface 1156 of element 1116. Moreover, the total area of surfaces 1158 and 1162 of exterior element 1118 equals the area of surface area 1178 within element 1132. Finally, the total area of front surfaces 1164 and 1168 of exterior element 1120 are equal to a total area of front surface 1172 of interior element 1130. Additionally, since the height of interior and exterior elements is generally identical, the same relationships exist regarding widths of respective surfaces in exterior and interior elements.

Figure 13:
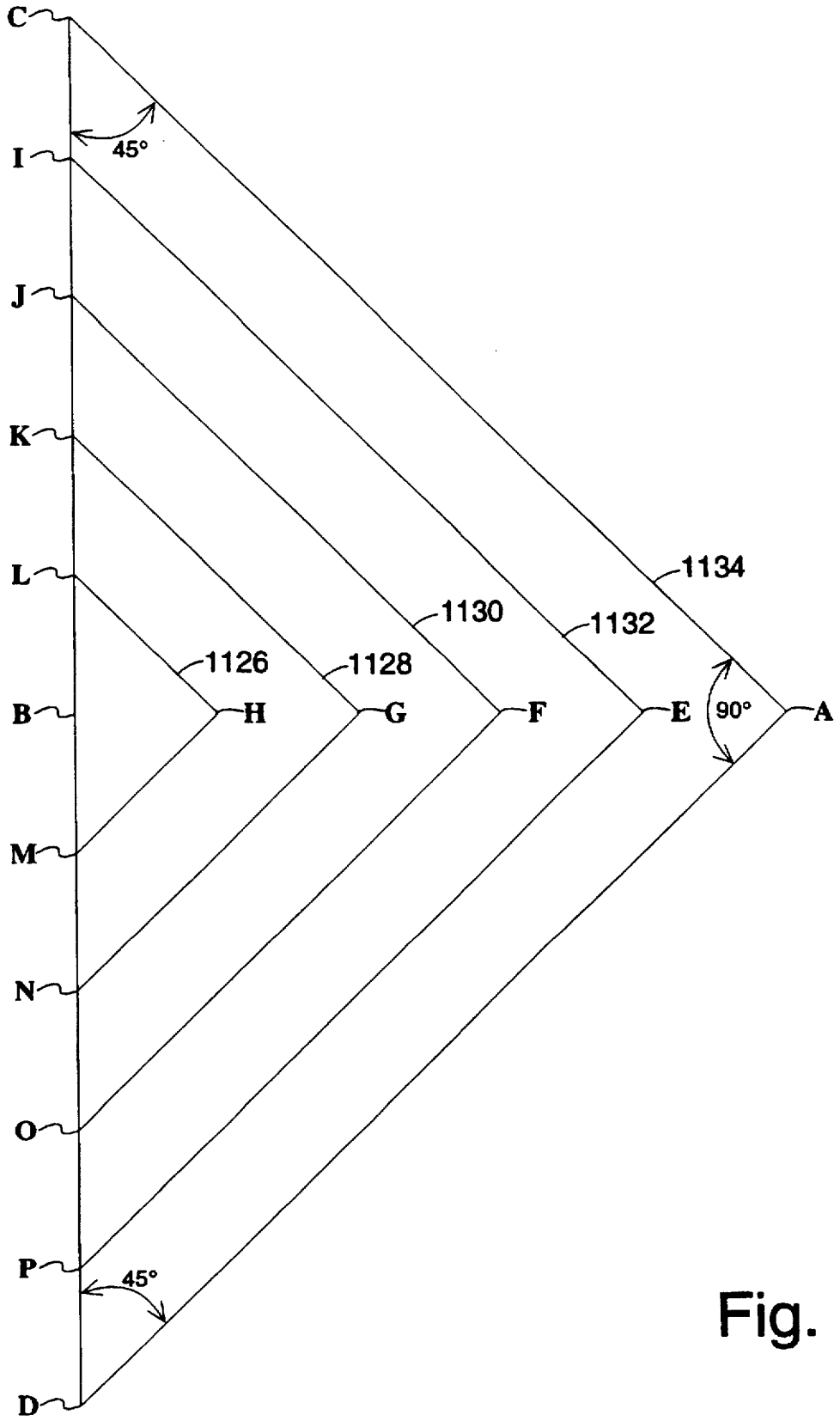
FIG. 13 is a top plan view of interior elements of a set of blocks according to the second embodiment of the present invention.

As is seen best from FIG. 8, sets 1105 and 1107 may be combined together to form a complete tetrahedron solid. Additionally, FIG. 13 illustrates a top plan view of a stack of interior elements. Although the elements of the present invention may be of any suitable size, an example of relative sizes of interior elements in stacks 1111 and 1113, as shown in FIG. 13, may be described in terms of distances from points A through P. First, the angle formed by points C, A, and D ("angle CAD") on interior element 1134 is 90°. Similarly, angle IEP on element 1132 is 90°, angle JFO on element 1130 is 90°, angle KGN on element 1128 is 90°, and angle LHM on element 1126 is 90°. Additionally, the two remaining angles of each of the interior elements at points C, D, I, J, J, K, L, M, N, O and P is 45°. As concerns relative sizes of each interior element, the distance between points C and D on interior element 1134 is 10 inches with point B being equidistantly placed therebetween. A distance between points A and B is 5 inches. The distance between points I and P on interior element 1132 is 8 inches, and a distance between points B and E is 4 inches. The distance the between points J and O on element 1130 is 6 inches, and a distance between points B and F is 3 inches. Similarly, the distance between points K and N on element 1128 is 4 inches, and the distance between B and G is 2 inches. Finally, the distance between points L and M on element 126 is 2 inches, and distance between points B and H is 1 inch.

Having all the dimensions of interior elements laid out, exterior elements of stacks 1109 and 1115 may be described in terms of the above-described points. For example, because of the complementary relationships between interior and exterior elements as described above, exterior element 1124 is defined by the distances between points A, D, P, E, I, and C; exterior element 1122 is defined by the distances between the points A, D, O, F, J, and C; exterior element 1120 is defined by the points A, D, N, G, K, and C; and exterior element 1118 is defined by the points A, D, M, H, L, and C.

Although those dimensions are used as an example in this particular embodiment, any dimensional relationship between forward, rear, and inside surface areas may be utilized which produces the surface area relationships described above. Finally, although any thickness may be utilized for elements above-referenced second embodiment, 0.75 inches is preferred in this embodiment. Additionally, each set of nested pairs within sets 1105 and 1107 may also have differing thicknesses, increasing thicknesses as a function of element height position in their respective stacks, or decreasing thicknesses as a function of element height within their respective stacks.

Furthermore, it is important to note that the sets 1105 and 1107 illustrated in FIG. 7 each have stacks of interior and exterior elements that are identical in their dimensions. Therefore the entire description set out above relating to dimensional relationships between nested elements, and surface areas of stacks 1109 and 1111 within set 1105 also applies to stacks 1113 and 1115 within set 1107. Therefore, the dimensions of interior and exterior elements of set 1107 in any amusement device may be identical to those of set 1105.

Figure 10:
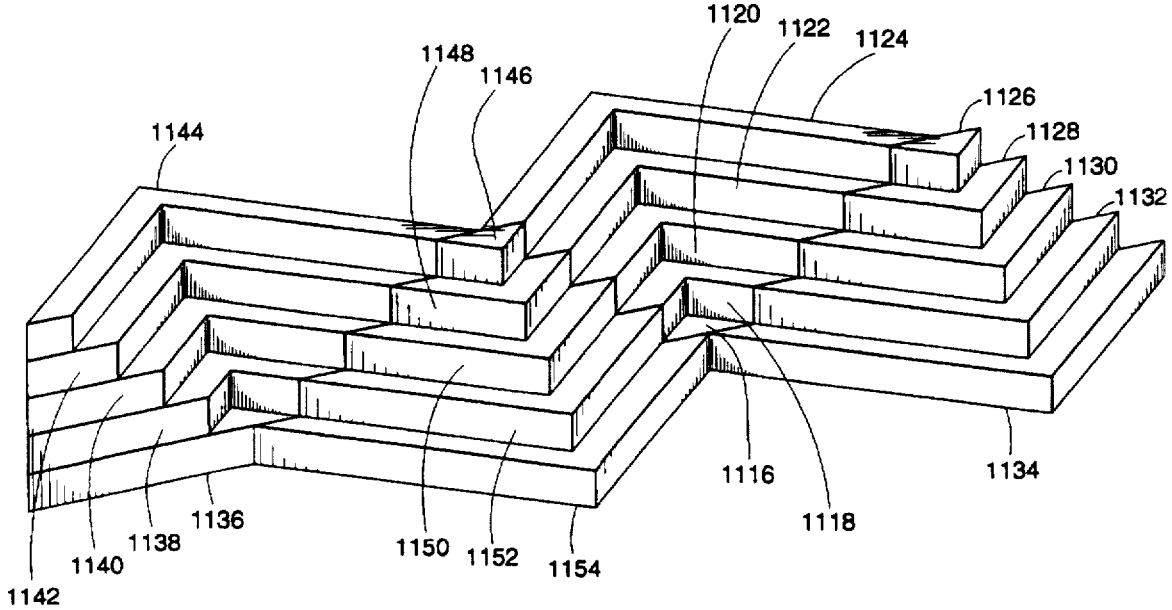
FIG. 10 is a perspective view of another example of a three-dimensional tierred sculpture formed from the second embodiment of the set of inventive blocks.

FIG. 10 illustrates one of many three-dimensional sculptures which can be created with the second embodiment of the present invention. In this particular sculpture, inside element 1146 covers front surfaces of outside elements 1144 and 1124. Similarly, inside element 1148 covers front surfaces of exterior elements 1142 and 1122. Interior element 1150 covers front surfaces of exterior elements 1120 and 1140, and a front surface of interior element 1152 covers front surfaces of exterior element 1138. Similarly, a front surface of element 1154 covers half of a front surface of element 1136 and half of a front surface of element 1116. Half of a front surface of element 1134 covers the remaining half of element 1116. Additionally, interior elements 1132, 1130, 1128 and 1126 are each stacked on one another to form a tiered relationship as described above, and each covers remaining front faces of exterior elements 1118, 1120, 1122 and 1124. The resulting sculpture is one having stepped contours of semi-circular curvatures. Although FIG. 10 illustrates a specific type of three-dimensional sculpture, a multitude of three-dimensional sculptures may be created using the present invention.

Figure 11:
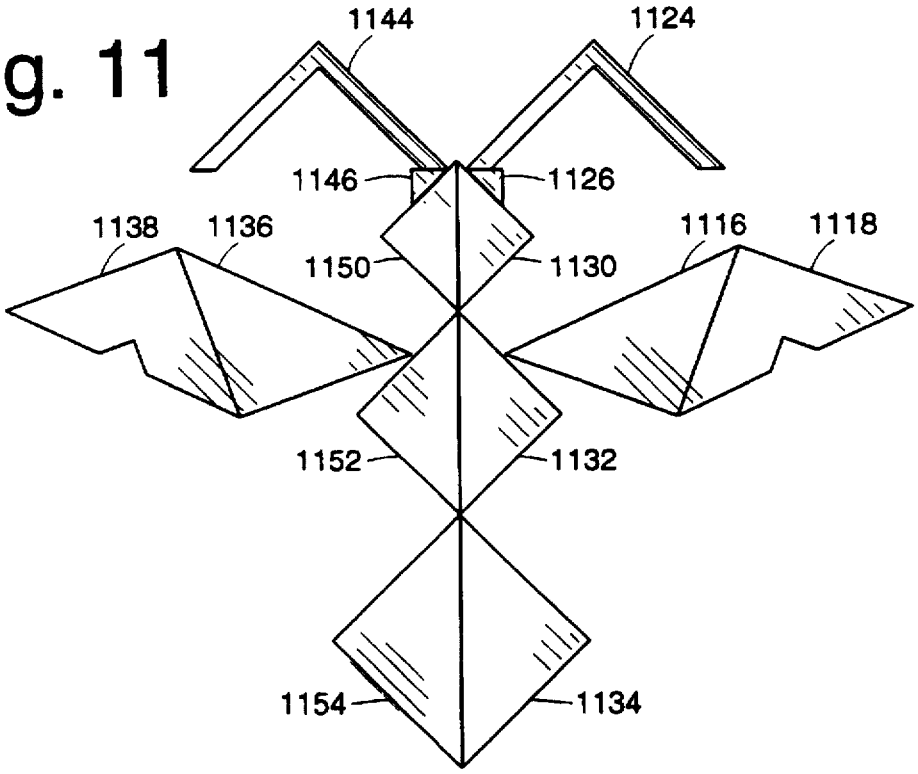
FIG. 11 is a perspective view of an example of a two-dimensional sculpture formed from the second embodiment of the set of inventive blocks.
Figure 12:
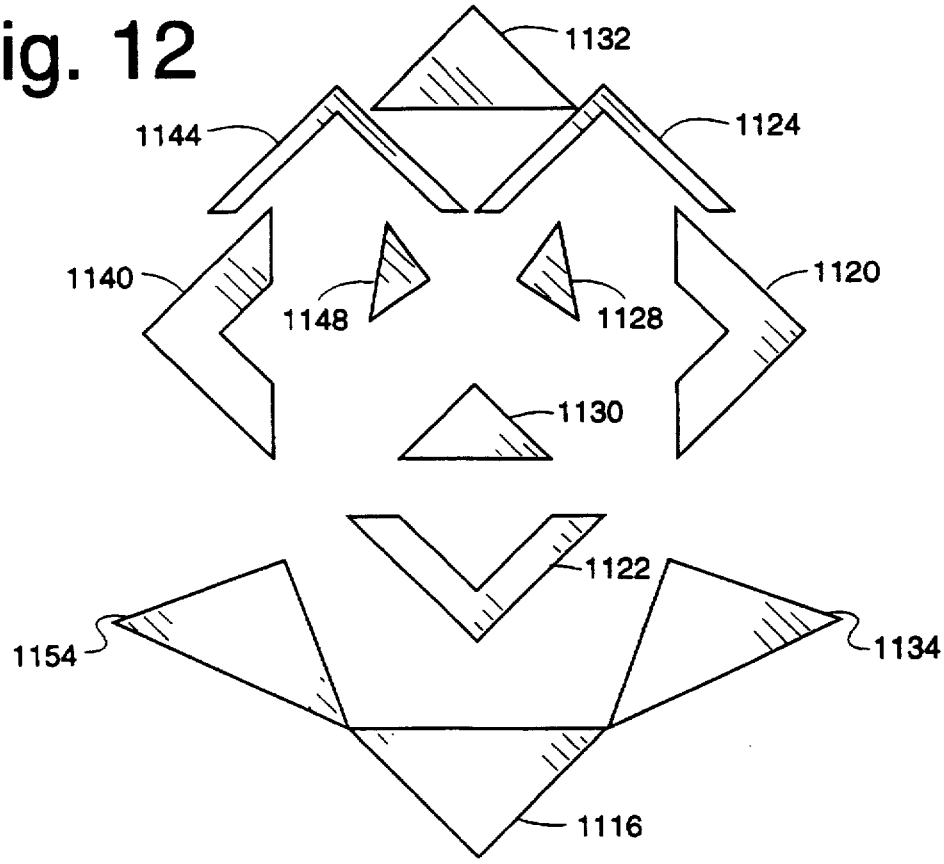
FIG. 12 is a perspective view of another example of a two-dimensional sculpture formed from the second embodiment of the set of inventive blocks.

FIGS. 11 and 12 each illustrate two dimensional sculptures which the amusement device may create. For example, FIG. 11 illustrates an insect-like creation having a head portion defined by elements 1130 and 1150, antennae portions defined by elements 1146, 1126, 1144, and 1124, a mid-body section defined by elements 1152 and 1132, an anterior body section defined by elements 1154 and 1134, and wing sections defined by elements 1138, 1136, 1116, and 1118.

FIG. 12 illustrates yet another example of a one dimensional sculpture that can be created with the set of elements. The sculpture generally resembles the face of a human-like being wherein elements 1126 and 1146 resemble eyes, elements 1144 and 1124 resemble eyebrows or eye outlines, element 1130 represents a top portion of the being's head, element 1128 represents a nose, elements 1140 and 1120 represent ears, element 1122 represents a mouth, and elements 1154, 1116, and 1134 represent the shoulders and chest of the human-like being.

The stackable elements of the present invention may be constructed from any substantially rigid material that is safe for young children. Examples of such material include, but are not limited to wood, plastic, ceramic, or sheet metal, or a combination thereof. The elements may all be of a single color, however, some or all of the elements may be of different colors to attract attention from young children, or for decorative effects.

It should be understood that various changes to the present invention may be made by the ordinarily skilled artisan, without departing from the spirit and scope of the present invention which is presented in the claims below. For example, the elements may be constructed from virtually any material, may be of any color, may have any shape and may have any particular size, so long as the above-referenced nesting elemental relationships exist within the stack of elements. Additionally, the ordinarily skilled artisan will understand that this disclosure represents an example of the invention and is not meant to limit the invention, as presented in the claims, in any way whatsoever.

What is claimed is:

1. A sculpture amusement device formed of a plurality of stackable elements which may form a vertical stack having a stack profile, said device comprising:

a plurality of interior elements, each of said interior elements including a front surface, a rear surface, a top surface and a bottom surface;

each of said plurality of interior elements being of a different size and accordingly having different surface areas as defined by said top and bottom surfaces;

a plurality of exterior elements, each of said exterior elements including first and second offset front surfaces and a rear surface, each first and second front surfaces defining an opening having an inside surface complementary to the rear surface of only one of said plurality of interior elements wherein each of said respective openings is configured to receive one and only one of said plurality of different sized interior elements;

said exterior elements also including top and bottom surfaces of different sizes and accordingly different surface areas as defined by said top and bottom surfaces;

whereby a respective of an interior element is received within an opening of a respective exterior element such that the combination of said interior element with its complementary exterior element define a stacking pair having a predetermined surface area as defined by the combination of the respective top surface areas of the mating interior and exterior elements; and wherein each of said respective stacking pairs of complementary interior and exterior elements define equivalent top surface areas to enable stacking of each respective pair within a general stack profile.

2. The amusement device of claim 1 wherein each said interior element is a semi-circular solid.

3. The amusement device of claim 1 wherein each said exterior element is substantially C-shaped.

4. The amusement device of claim 1, further wherein said stack of nested interior and exterior elements forms a semi-cylindrical solid.

5. The amusement device of claim 1 wherein each said interior element is a triangular solid.

6. The amusement device of claim 1 wherein each said exterior element is substantially V-shaped.

7. The amusement device of claim 1, further wherein said stack of nested interior and exterior elements forms a triangular solid.

8. The amusement device of claim 1 wherein interior elements disposed at a distance downward from a top element position in said stack have a front surface area equal to a total surface area of said first and second front surfaces of exterior elements located at an element position within said stack at a same distance upward from a bottom element position in said stack.

* * * * *